US008483412B2

(12) United States Patent
Statham et al.

(10) Patent No.: US 8,483,412 B2
(45) Date of Patent: Jul. 9, 2013

(54) VARIABLE PATTERN HANGING MICROPHONE SYSTEM WITH REMOTE POLAR CONTROL

(75) Inventors: Kelly Statham, Cleveland Heights, OH (US); Craig Huffman, Ashtabula, OH (US)

(73) Assignee: CAD Audio, LLC, Solon, OH (US)

( * ) Notice: Subject to any disclaimer, the term of this patent is extended or adjusted under 35 U.S.C. 154(b) by 479 days.

(21) Appl. No.: 12/783,396

(22) Filed: May 19, 2010

(65) Prior Publication Data

US 2010/0296674 A1 Nov. 25, 2010

Related U.S. Application Data

(60) Provisional application No. 61/179,889, filed on May 20, 2009.

(51) Int. Cl.

| | |
|---|---|
| ***H04R 17/02*** | (2006.01) |
| ***H04R 19/04*** | (2006.01) |
| *H04R 17/00* | (2006.01) |
| *H04R 19/00* | (2006.01) |

(52) U.S. Cl.
USPC ..... 381/174; 381/358

(58) Field of Classification Search
USPC ..... 381/174, 119, 358, 361, 362, 92
See application file for complete search history.

(56) References Cited

U.S. PATENT DOCUMENTS

| | | | | |
|---|---|---|---|---|
| 4,489,442 | A * | 12/1984 | Anderson et al. | 381/81 |
| 4,491,697 | A * | 1/1985 | Tanaka et al. | 381/113 |
| 4,527,019 | A * | 7/1985 | Lemp | 381/362 |
| 4,888,807 | A * | 12/1989 | Reichel | 381/92 |
| 4,991,220 | A * | 2/1991 | Wolf | 381/368 |
| 5,377,273 | A * | 12/1994 | Sutton | 381/122 |
| 6,424,723 | B1 * | 7/2002 | Jing | 381/361 |
| 6,459,802 | B1 * | 10/2002 | Young | 381/368 |
| 6,614,911 | B1 * | 9/2003 | Watson et al. | 381/86 |
| 6,724,904 | B1 * | 4/2004 | Winter | 381/361 |
| 7,068,797 | B2 * | 6/2006 | Isberg et al. | 381/92 |
| 7,106,876 | B2 * | 9/2006 | Santiago | 381/369 |
| 7,889,882 | B2 * | 2/2011 | Marshall | 381/355 |
| 7,903,829 | B2 * | 3/2011 | Kubota | 381/174 |
| 2001/0028718 | A1 * | 10/2001 | Hou | 381/92 |
| 2006/0222187 | A1 * | 10/2006 | Jarrett et al. | 381/92 |
| 2006/0262946 | A1 * | 11/2006 | Yang | 381/175 |
| 2007/0014419 | A1 * | 1/2007 | Steele | 381/92 |
| 2009/0190775 | A1 * | 7/2009 | Reining | 381/92 |
| 2009/0323980 | A1 * | 12/2009 | Wu et al. | 381/92 |
| 2011/0096951 | A1 * | 4/2011 | Lee et al. | 381/352 |
| 2011/0188694 | A1 * | 8/2011 | Lee et al. | 381/356 |
| 2011/0235821 | A1 * | 9/2011 | Okita | 381/92 |

OTHER PUBLICATIONS

F.W. O. Bauch, New High-Grade Condenser Microphones, Journal of the Audio Engineering Society, Jul. 1953, vol. 1, No. 3.

Druck-Centrum Furst GmbH, Berlin, Germany, Microphones 'Methods of Operation and Type Examples,' Fourth Edition 1999, website: www.neumann.com.

* cited by examiner

*Primary Examiner* — Edgardo San Martin
(74) *Attorney, Agent, or Firm* — Emerson Thomson Bennett; Roger D. Emerson; Sergey Vernyuk

(57) ABSTRACT

A microphone system includes a microphone and a control device external to the microphone. The microphone includes at least two capacitor capsules or one dual-sided capsule. The control device is capable of varying the polar pattern of the microphone over a two-conductor shielded cable or wirelessly. The microphone system may include an anti-rotational positioning mount for the microphone.

15 Claims, 11 Drawing Sheets

VARIABLE PATTERN HANGING MICROPHONE SYSTEM WITH REMOTE POLAR CONTROL

This application claims the benefit of U.S. Provisional Application No. 61/179,889, titled VARIABLE PATTERN HANGING MICROPHONE SYSTEM WITH REMOTE POLAR CONTROL, filed May 20, 2009, which is herein incorporated by reference.

I. BACKGROUND

A. Field of Invention

The present invention relates generally to electronics, and more specifically to professional or commercial microphones and audio accessories.

B. Description of the Related Art

Microphones are acoustic-to-electric transducers or sensors that convert sound into electrical signals. A common microphone design uses a thin membrane which vibrates in response to sound pressure. Most microphones in use today use electromagnetic induction (dynamic microphone), capacitance change (condenser microphone), piezoelectric generation, or light modulation to produce the signal from mechanical vibration.

Condenser microphones, also known as capacitor microphones, contain a capacitor that has two plates with a voltage between them. One of the plates is known as the diaphragm and is made of a very light material. The diaphragm vibrates when struck by sound waves, changing the distance between the plates and therefore changing the capacitance and forming an electrical signal, which then needs amplification. When the plates are closer together, capacitance increases and a charge current occurs. When the plates are further apart, capacitance decreases and a discharge current occurs. A voltage must be supplied across the capacitor either by battery or external phantom power. Condenser microphones produce a high-quality audio signal and are popular in laboratory and studio recording applications. They have a greater frequency response and transient response, which is the ability to reproduce the "speed" of an instrument or voice.

The way that microphones pick up sound from different directions is known as a pickup pattern. The patterns are usually depicted as polar diagrams, a circular graph of sensitivity of a microphone from various directions. A microphone's directionality or polar pattern indicates how sensitive it is to sounds arriving at different angles about its central axis. Depending on the situation, some microphone patterns are more suitable than others. For example, an omnidirectional pattern picks up sound well from all directions and is frequently used for recording ambient and background sound. A uni-directional pattern is most sensitive to sound coming from directly in front of the microphone. This pattern is useful when sounds are coming from a specific direction. A heart-shaped pattern, known as a cardioid pattern, rejects sound coming from the back of a microphone and is progressively more sensitive to sounds as the direction approaches the front of the microphone. The cardioid pattern is favored for stage use, as they do not readily pick up sound from on stage speakers or monitors, thus preventing feedback.

Typically, the structure of the microphone defines its directivity and its polar pattern. The structural shape of the microphone capsule has been of major importance in determining the pickup pattern. For example, a capsule that is closed on one side results in an omni-directional pattern, while the cardioid pattern results from a capsule with a partially closed backside. Remote control of microphone polar patterns has previously been achieved only through special, multi-conductor cables and connects.

Therefore, what is needed is a method and apparatus for the remote control of polar patterns in continuously variable pattern microphones using standard microphone cabling.

II. SUMMARY

According to one embodiment of this invention, a microphone system may include a microphone having two capacitor capsules or one dual-sided capsule having two diaphragms. The two capacitor capsules or one dual-sided capsule can be cardioid capacitor capsules. The microphone system may include a control device external to the microphone, wherein the control device is capable of varying the polar pattern of the microphone. The control device can be connected to the microphone with a two-conductor shielded cable having a first conductor and a second conductor. The control device may include a high-pass filter, which is controlled by the control device. The signal from the first capsule or first diaphragm is on the first conductor of the two-conductor shielded cable and the signal from the second capsule or second diaphragm is on the second conductor of the two-conductor shielded cable. The control device can alter the amplitude and polarity of the signal from the second capsule or second diaphragm. The two signals remain separate until the signals enter a differencing amplifier in a mixer or preamplifier, where the actual polar pattern is created. The microphone system may include a printed circuited board located between the two capacitor capsules or the two diaphragms in the dual-side capsule. The printed circuit board can function as an acoustic baffle between the two capsules or diaphragms. The microphone system may include an anti-rotational positioning mount. The anti-rotational positioning mount may include an upper support arm secured to an associated ceiling, a counterpoise rod operatively attached to the microphone, and a cable rod operatively attached to the microphone, wherein the anti-rotational positioning mount maintains the position of the microphone utilizing a thread attached to the upper support arm and the counterpoise rod.

According to another embodiment of this invention, a microphone system may include a microphone having at least two capacitor capsules; a control device external to the microphone and operatively connected to the microphone, wherein the control device is capable of varying the polar pattern of the microphone. The microphone system may include an anti-rotational positioning mount for the microphone. The at least two capacitor capsules can be cardioid capacitor capsules. The control device can be connected to the microphone with a cable. The control device can be wireless connected to the microphone. The microphone may include a high-pass filter, which is controlled by the control device. The control device may include a high-pass filter, which is controlled by the control device. The control device can vary the polar pattern when the microphone is in use. The control device can continuously vary the polar pattern of the microphone when the microphone is in use. The control device can continuously vary the polar pattern of the microphone among any one of the group including a figure-of-eight polar pattern, a hypercardioid polar pattern, a cardioid polar pattern, a wide-angle cardioid polar pattern, and an omnidirectional polar pattern when the microphone is in use. The control device can continuously vary the polar pattern of the microphone among any one of the group consisting of a figure-of-eight polar pattern, a hypercardioid polar pattern, a cardioid polar pattern, a wide-angle cardioid polar pattern, and an omnidirectional polar pattern when the microphone is in use. The control device can continuously vary the polar pattern of the microphone among any one of the group including a figure-of-eight polar pattern, a hypercardioid polar pattern, a cardioid polar pattern, a wide-angle cardioid polar pattern, an omnidirectional polar pattern, and any combination thereof when the microphone is in use. The control device can continuously vary the polar pattern of the microphone among any one of the group consisting of a figure-of-eight polar pattern, a hypercardioid polar pattern, a cardioid polar pattern, a wide-angle cardioid polar pattern, an omnidirectional polar pattern, and any combination thereof when the microphone is in use.

According to another embodiment of this invention, a method may include the steps of varying the polar pattern of a microphone with a control device external to the microphone, wherein the microphone includes at least two capacitor capsules. The method may further include the step of maintaining the position of the microphone with an anti-rotational positioning mount. The at least two capacitor capsules can be cardioid capacitor capsules. The step of varying the polar pattern may further include connecting the control device to the microphone with a cable. The step of varying the polar pattern may further include connecting the control device to the microphone using a wireless connection. The method may further include the step of switching on and off a high-pass filter located in the microphone using the control device. The method may further include the step of switching on and off a high-pass filter located in the control device using the control device. The step of varying the polar pattern may further include varying the polar pattern of the microphone when the microphone is in use. The method may further include the step of changing the polar pattern of the microphone when the microphone is in use. The step of varying the polar pattern may further include varying the polar pattern of the microphone among any one of the group including a figure-of-eight polar pattern, a hypercardioid polar pattern, a cardioid polar pattern, a wide-angle cardioid polar pattern, and an omnidirectional polar pattern when the microphone is in use. The step of varying the polar pattern may further include varying the polar pattern of the microphone among any one of the group including a figure-of-eight polar pattern, a hypercardioid polar pattern, a cardioid polar pattern, a wide-angle cardioid polar pattern, an omnidirectional polar pattern, and any combination thereof when the microphone is in use.

According to another embodiment of this invention, a microphone system includes a continuously variable pattern microphone with a remote polar control design and an anti-rotational positioning mount. The microphone includes a microphone element enclosure. Enclosed within the microphone element enclosure are a microphone head, at least two cardioid capacitor capsules facing opposite directions, a diode, and a power source. The rear of the microphone element enclosure includes a connector, which attaches to one end of a two-conductor shielded cable. The other end of the two-conductor shielded cable is attached to a control device. The control device varies the polar pattern utilizing the two cardioid capacitor capsules. The microphone is positioned on the anti-rotational positioning mount.

One advantage of this invention is the microphone system allows a user to adjust the polar pattern in real time without changing capsules, microphone positions, or inducing noise in the audio chain. Another advantage of this invention is the microphone system provides for remote control of microphone polar patterns using a standard two-conductor shielded cable and connectors. This allows for installation of the microphone system of the present invention using standard cabling and connection without the added time and expense of upgrading to special, multi-conductor cables and connectors.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
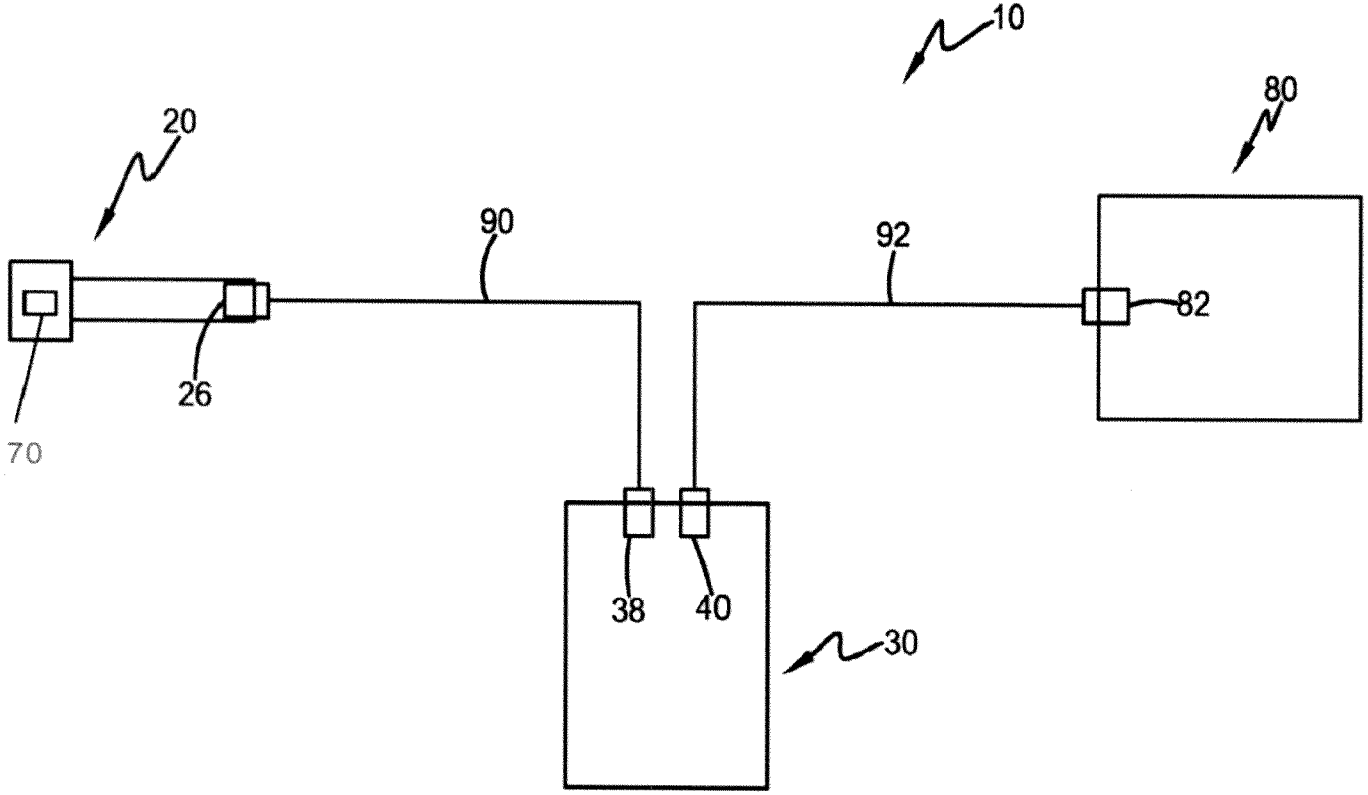
FIG. 1 is a schematic diagram of a microphone system, according to one embodiment.
Figure 2A:
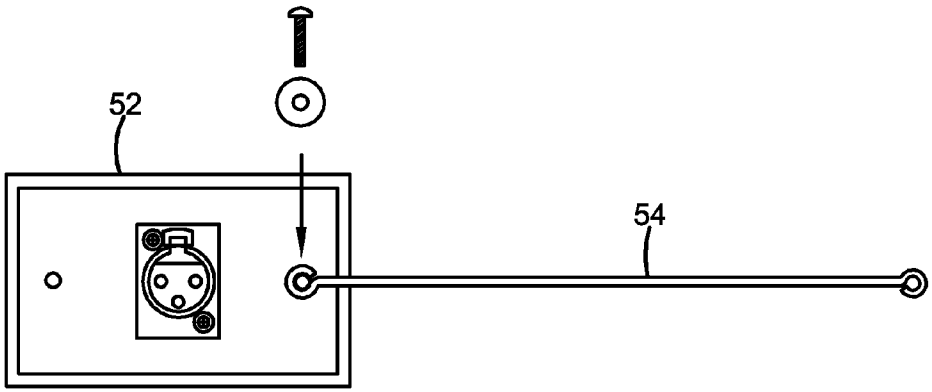
FIG. 2 is a schematic drawing of the elements of the microphone system, according to one embodiment.
Figure 2B:
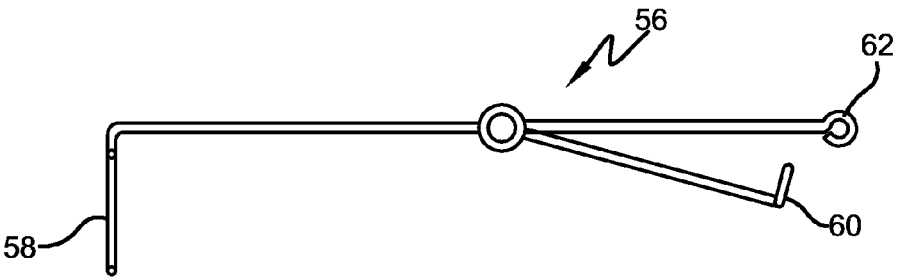
Figure 3:
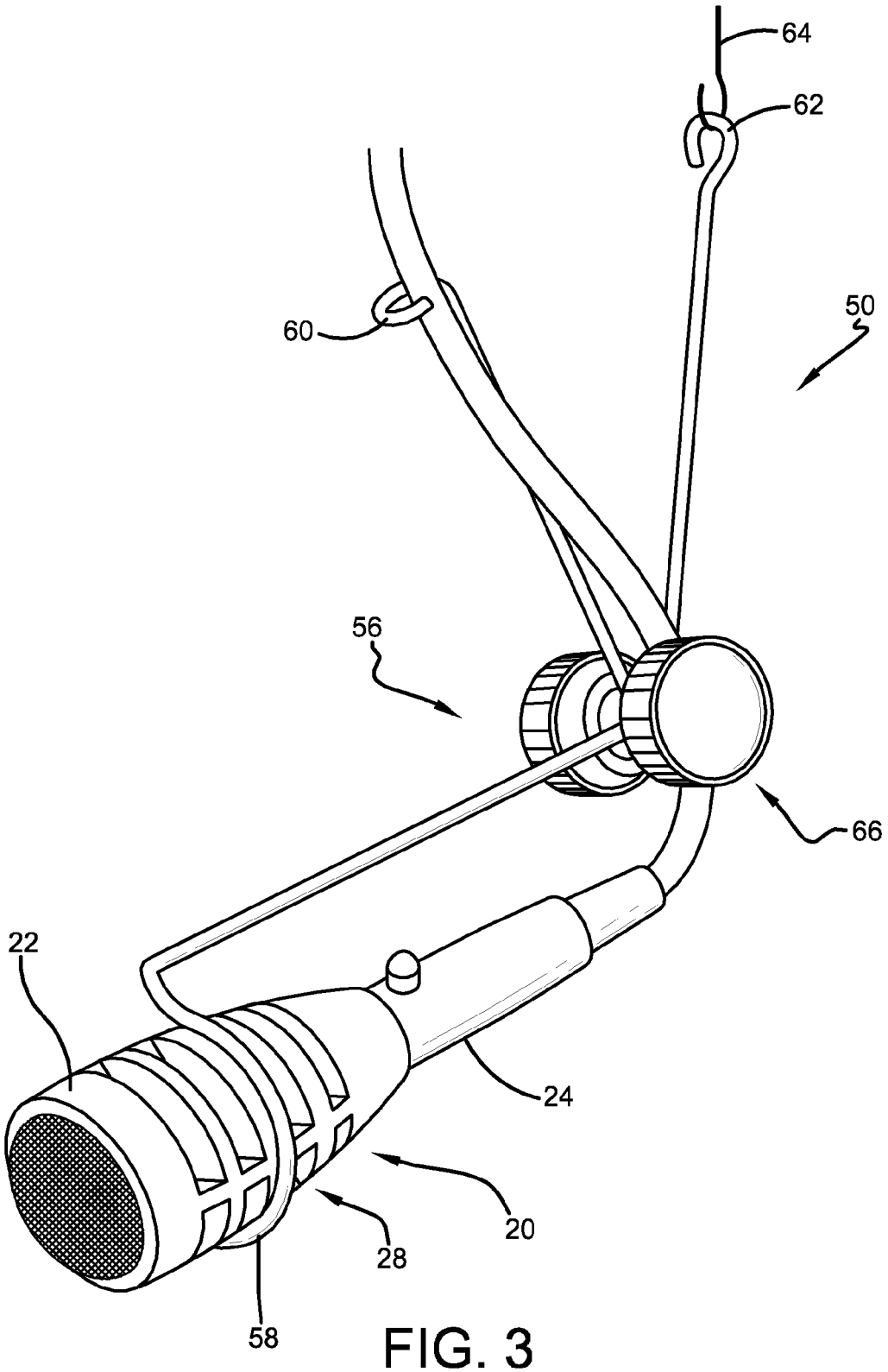
FIG. 3 is a perspective view of a microphone, according to one embodiment.

Referring now to the drawings wherein the showings are for purposes of illustrating embodiments of the invention only and not for purposes of limiting the same, and wherein like reference numerals are understood to refer to like components, FIG. 1 shows a microphone system 10, which may include a microphone 20, a control device 30, and a mixer 80. The mixer 80 can be an audio mixer, a recording device, or a preamplifier. The microphone 20 may include a connection device 26, which can be any device chosen by a person having ordinary skill in the art. The connection device 26 can be a TA3M-type or TA3F-type connector in one embodiment or a wireless communication device in another embodiment. The control device 30 may include connection devices 38, 40, which can be any device chosen by a person having ordinary skill in the art. The connection devices 38, 40 can be 3-pin XLRM-type or 3-pin XLRF-type connectors in one embodiment or a wireless communication device in another embodiment. The mixer 80 may include a connection device 82, which can be any device chosen by a person having ordinary skill in the art. The connection device 80 can be a 3-pin XLRM-type or 3-pin XLRF-type connector in one embodiment or a wireless communication device in another embodiment. The mixer 80 can provide phantom power to the microphone system 10. All of the wireless communication devices discussed herein can transmit and receive signals in the electromagnetic spectrum including, but not limited to, radio, infrared, and laser.

With continuing reference to FIG. 1, a cable 90 can connect the microphone 20 to the control device 30, and a cable 92 can connect the control device 30 to the mixer 80. The cables 90, 92 can be any cable chosen by a person having ordinary skill in the art. In one embodiment the cables 90, 92 are two-conductor shielded cables. In another embodiment, the cables 90, 92 are microphone cables or analog audio cables. The cable 90 can have a a TA3M-type or TA3F-type connector at one end to connect to the microphone 20 and a 3-pin XLRM-type or 3-pin XLRF-type connector at the other end to connect to the control device 30. The cable 92 can have a 3-pin XLRM-type or 3-pin XLRF-type connector at one end to connect to the control device 30 and a 3-pin XLRM-type or 3-pin XLRF-type connector at the other end to connect to the mixer 80.

With reference now to FIGS. 2A, 2B, 3, 9A, and 9B the microphone system 10 may include a mount 50. The microphone 20 is designed to hang from a ceiling using mount 50 or mount on a microphone boom. The mount 50 may include a wall plate 52 and an upper support arm 54. The mount 50 may include an articulating hanger 56. The articulating hanger 56 may include a microphone loop 58 for receiving a microphone head 22, a cable loop 60 for receiving the microphone cable 90, a thread or wire loop 62 for receiving anti-twist thread or wire 64, and a adjusting device 66 for allowing adjustment of the microphone angle. The wire loop 62 can serve as an anti-rotational counterpoise. In one embodiment, the thread 64 can attach directly above the microphone 20 by using the counterpoise rod 62 in a horizontal position.

With reference now to FIGS. 1 and 3-5, the microphone 20 may include a microphone head 22 and a microphone housing 24. In one embodiment, the microphone 20 is a continuously variable pattern condenser microphone. In one specific embodiment, the microphone 20 has a sensitivity of −29 dBV (35 mV) @ 1 Pa, a frequency response of 40 Hz to 20 KHz. an impedance of 135 ohms, self noise of 22 dBA, and a maximum SPL of 110 dB. The microphone 20 may include at least one capacitor capsule 70. Each capacitor capsule 70 includes a diaphragm, which is a thin piece of material that vibrates when struck by sound waves. In one embodiment, the microphone 20 includes two capacitor capsules 70. In another embodiment, the microphone 20 includes one dual-sided capsule 70 having two diaphragms. The two capacitor capsules 70 can be arranged back-to-back, in which each diaphragm is fitted on an opposite side of a common backplate. The two capacitor capsules 70 can be single-sided capsules, dual-sided capsules, omnidirectional capsules, bi-directional capsules, cardioid capsules, or any combination of these capsules. In one embodiment, the capacitor capsules 70 are both cardioid capacitor capsules. The microphone 20 may include more than two capacitor capsules 70. The microphone system 10 may vary the polar pattern of the microphone 20 by applying different amounts of power to one or both capacitor capsules 70 or by varying the signal level in one or both capacitor capsules 70. The microphone system 10 may vary the polar pattern of the microphone 20 by switching the polarity of one or both capacitor capsules 70 or by switching the phase in one or both of the capacitor capsules 70. The microphone 20 can operate on P12, P24, or P48 standard phantom power consuming approximately 4 mA. The microphone 20 may include a high-pass filter 28 for increased intelligibility. In one embodiment, the microphone 20 includes an 80 Hz, 12 dB/octave high pass filter 28. The microphone 20 has an RF (radio frequency) resistant architecture, which meets or exceeds EN55103-2, E1, E2, E3, and E4. The microphone 20 also meets stringent RF standards set by the European Union. In one embodiment, the microphone head 22 is approximately 1 11/16 inches long with an approximately ¾ inch diameter.

Figure 4:
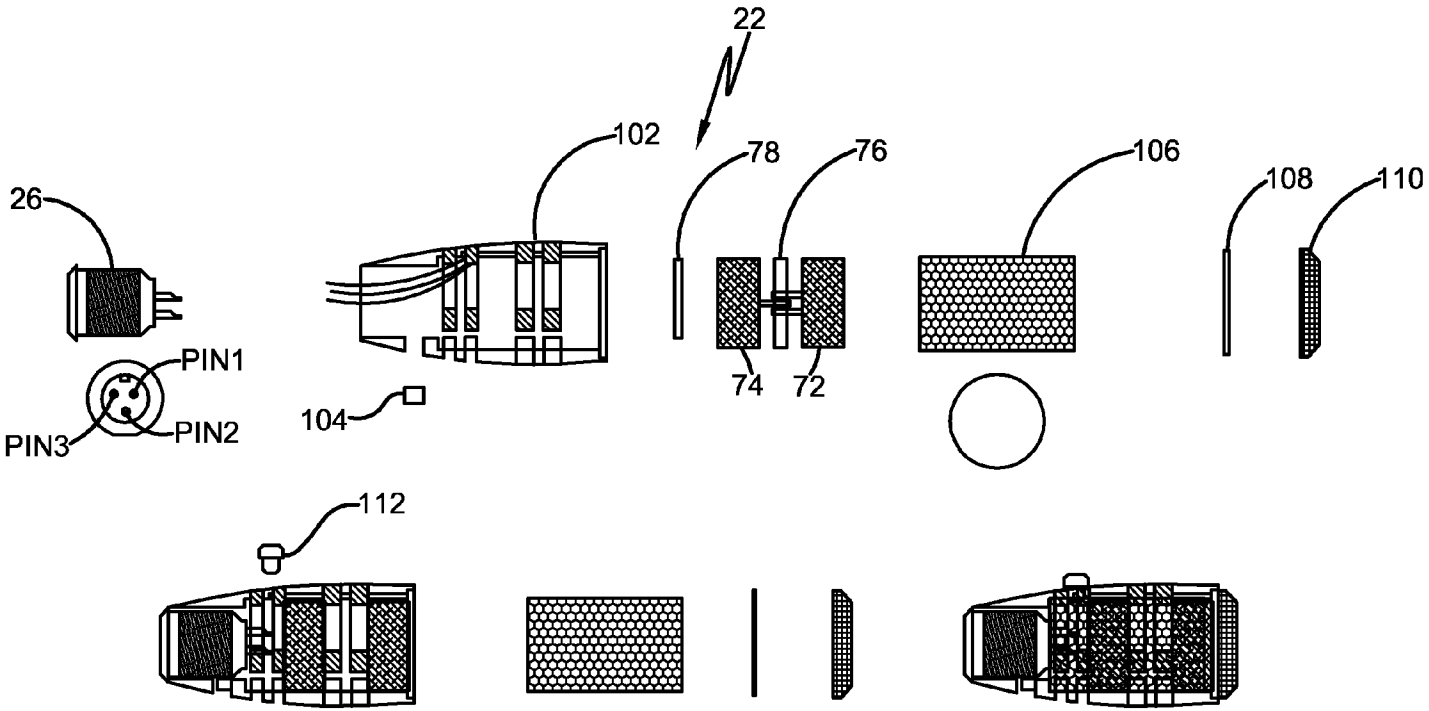
FIG. 4 is an assembly drawing of the microphone, according to one embodiment.
Figure 4B:
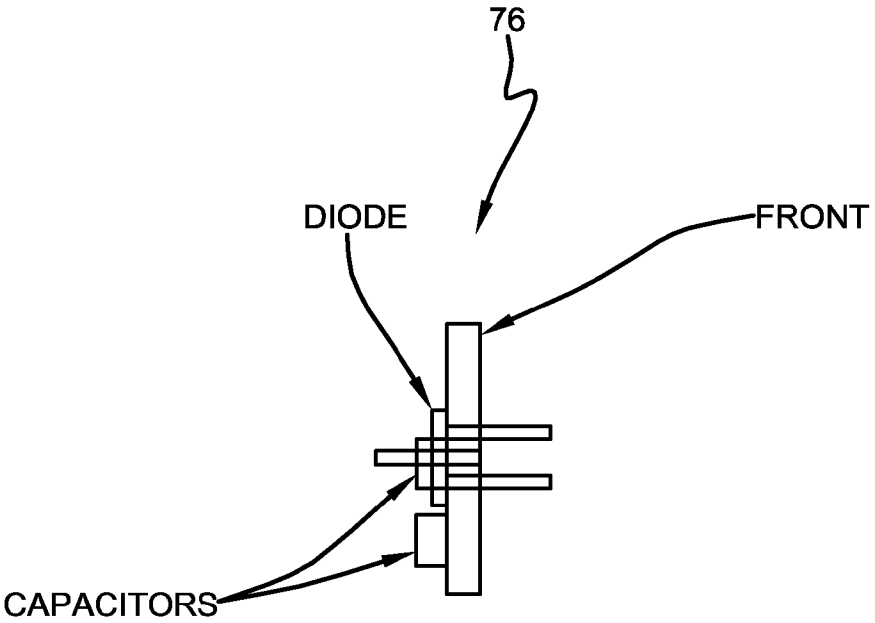
FIG. 4B is a schematic drawing of a printed circuit board of the microphone, according to one embodiment.
Figure 4A:
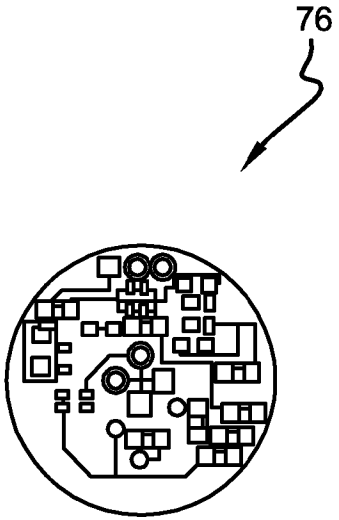
FIG. 4A is a schematic drawing of a printed circuit board of the microphone, according to one embodiment.
Figure 5:
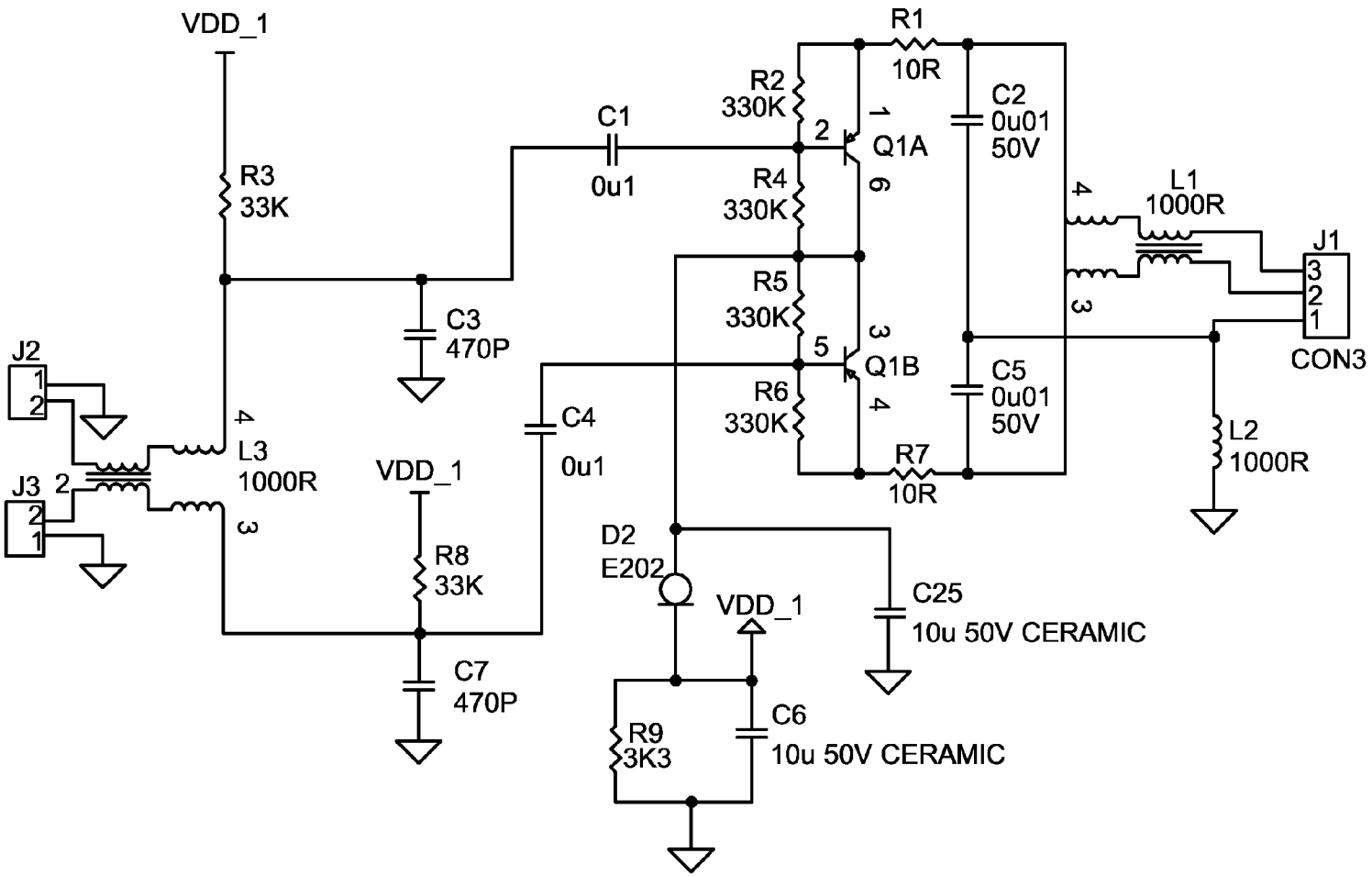
FIG. 5 is a circuit diagram of the microphone, according to one embodiment.

With continuing reference to FIGS. 4, 4A, and 4B, the microphone head 22 may include a connection device 26, as discussed above, which in one embodiment is a TB3 MB-type connector. The microphone head 22 may include a body 102, a set screw 104, an inner screen 106, a silk 108, a screen 110, and a mount screw 112. The microphone head 22 may include a printed circuit board 76, a front capacitor capsule 72, a rear capacitor capsule 74, and a rear baffle 78. Besides being a substrate for the electronics, the printed circuit board 76 can also function as an acoustic baffle between the front and rear capsules 72, 74 to significantly improve the variable pattern performance and the polar response.

Figure 6:
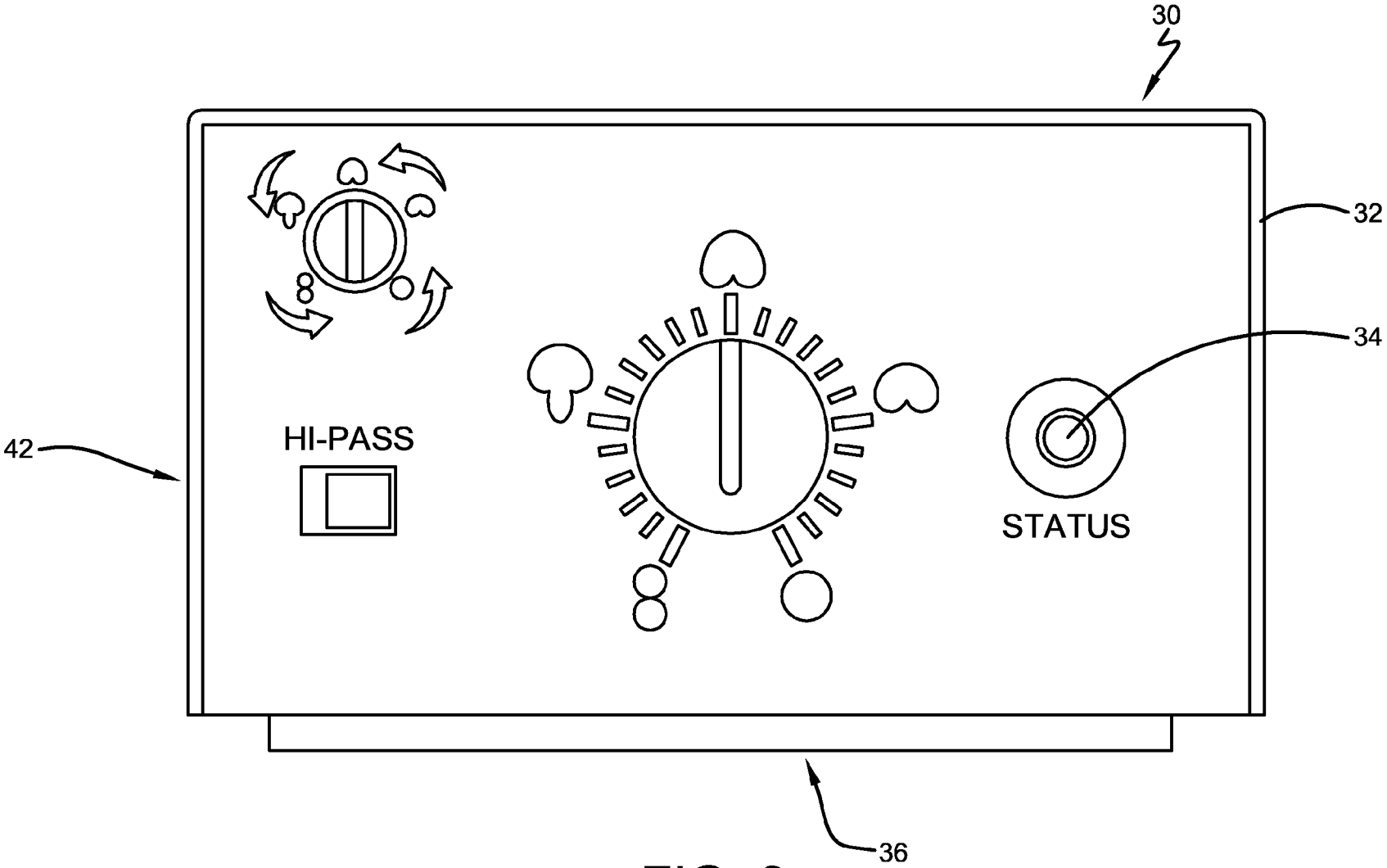
FIG. 6 is a perspective view of the control device, according to one embodiment.
Figure 7:
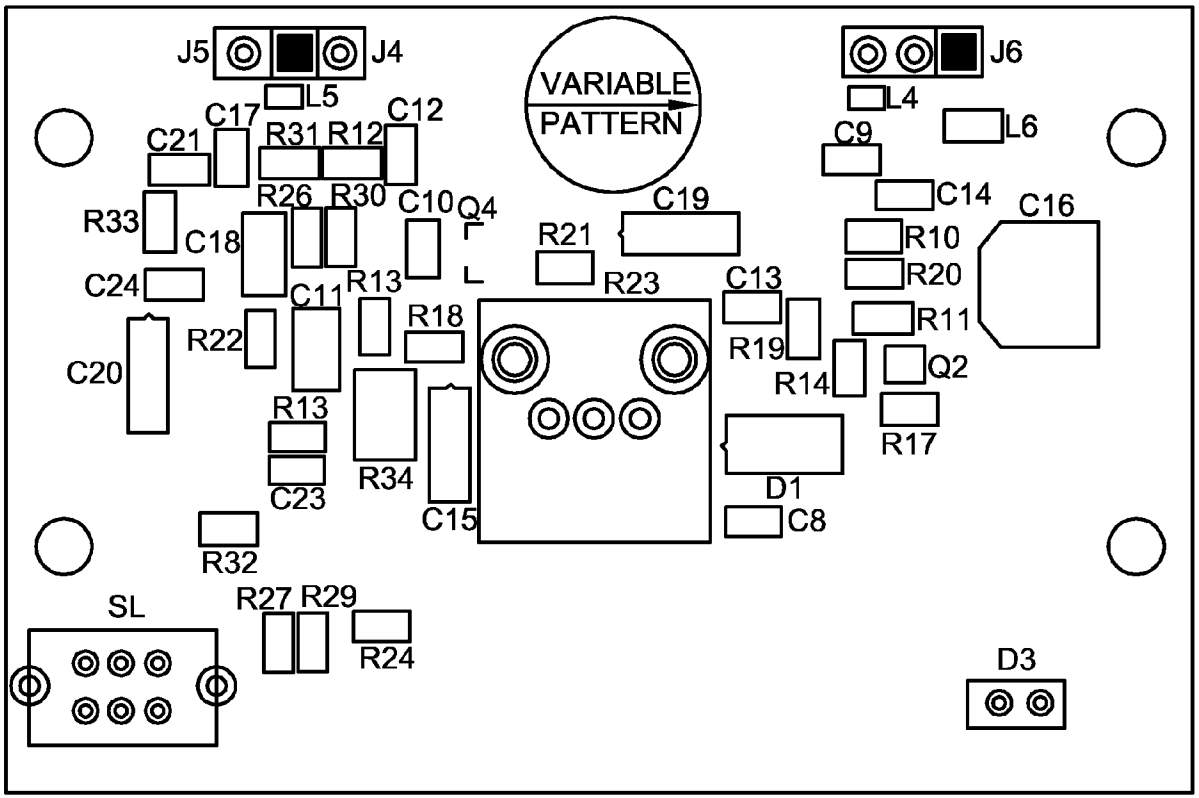
FIG. 7 is a schematic drawing of a printed circuit board of the control device, according to one embodiment.
Figure 8:
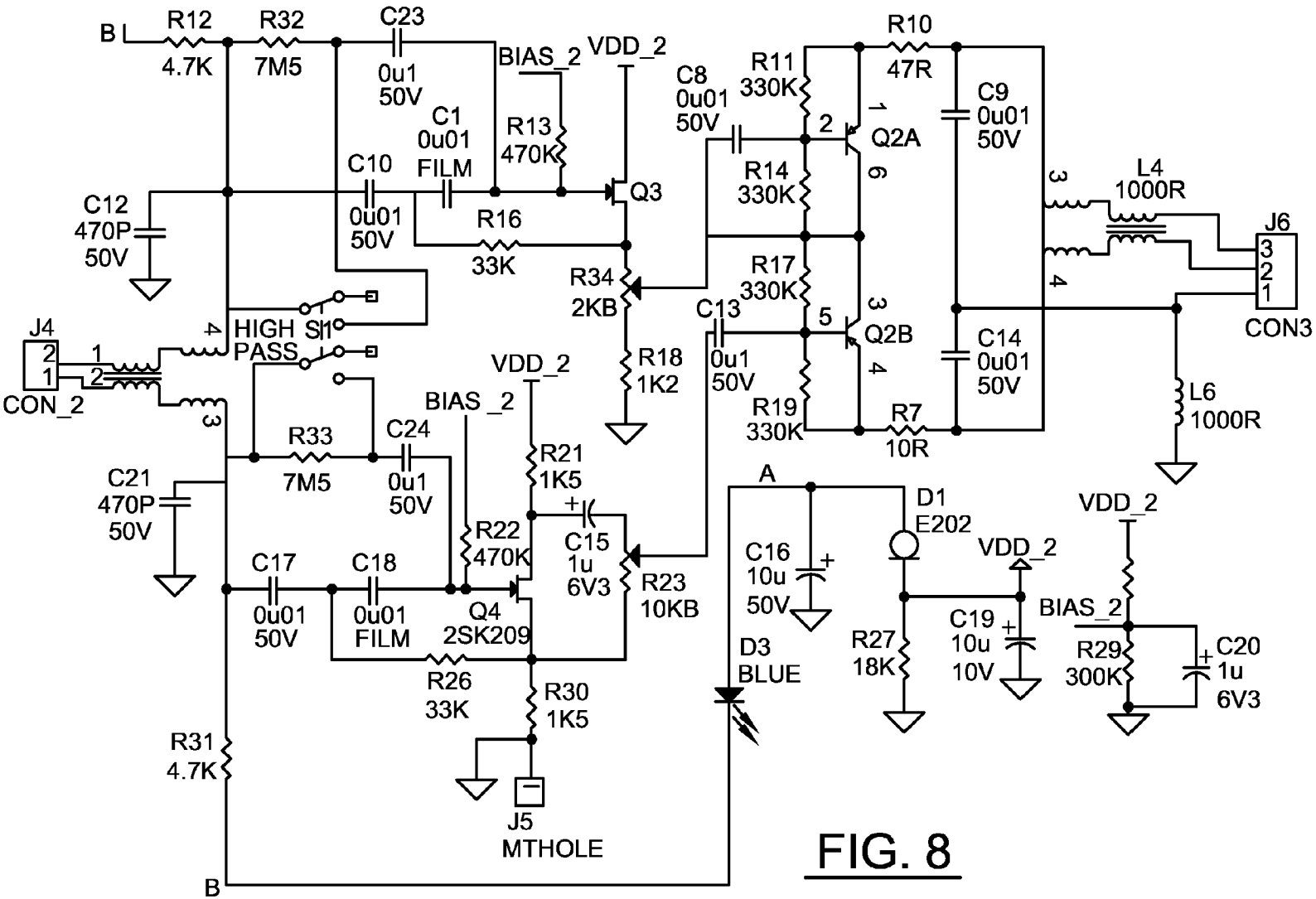
FIG. 8 is a circuit diagram of the control device, according to one embodiment.
Figure 9B:
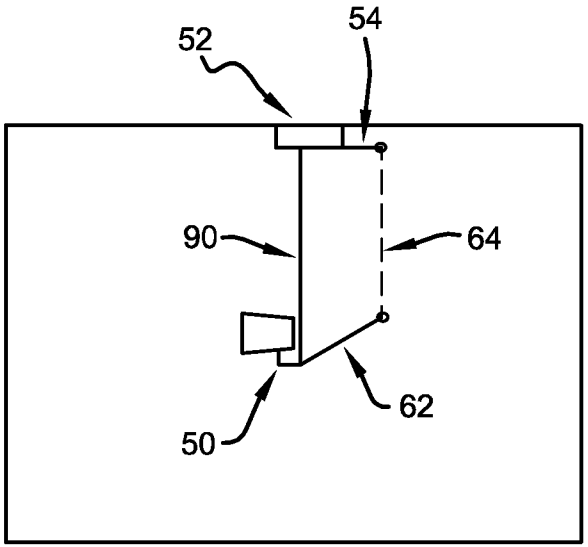
FIG. 9B is a side perspective view of the anti-rotational mount with counterpoise, according to one embodiment.
Figure 9A:
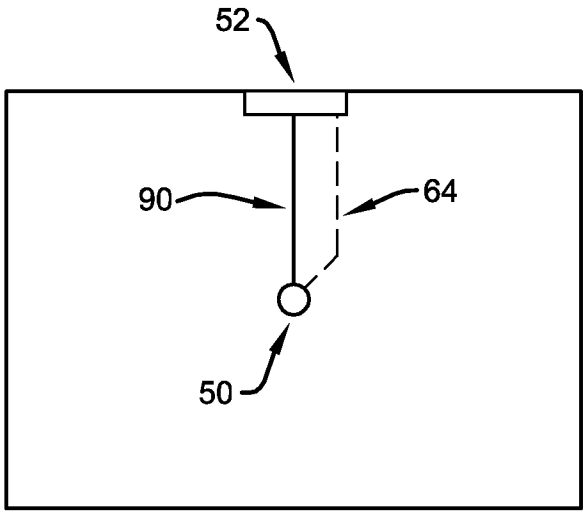
FIG. 9A is a front perspective view of an anti-rotational mount with counterpoise, according to one embodiment.
Figure 10B:
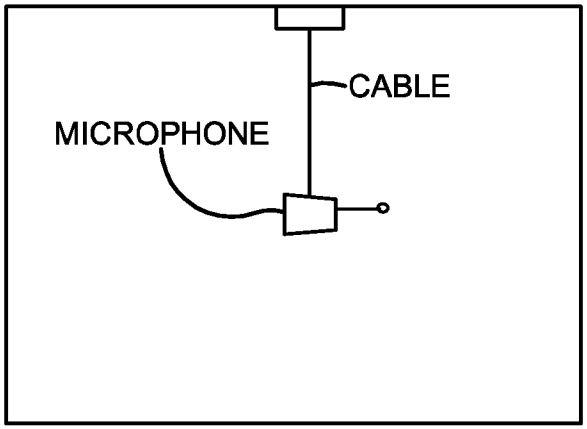
FIG. 10B PRIOR ART
FIG. 10B is a side perspective view of the prior art microphone installation.
Figure 10A:
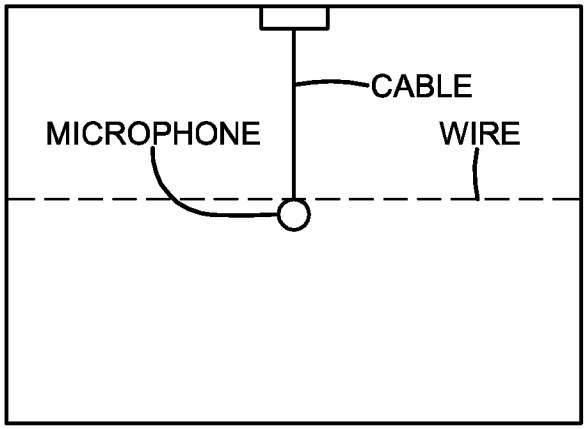
FIG. 10A PRIOR ART
FIG. 10A is a front perspective view of the prior art microphone installation.

With reference now to FIGS. 6-8, the control device 30 may include a housing 32, an indicator 34, a polar pattern adjustment 36, and a high-pass filter switch 42. In one embodiment, the indicator 34 is a blue LED. The control device 30 may include a high-pass filter 28 for increased intelligibility. The polar pattern adjustment 36 can be a dial, which adjusts the polar pattern of the microphone 20. By adjusting the polar pattern adjustment 36, the control device 30 can vary the polar pattern of the microphone 20 among a variety of polar patterns and combinations of polar patterns. In one embodiment, the control device 30 can vary the polar pattern of the microphone 20 among and between any one of the following polar patterns: bi-directional or figure-of-eight, hypercardioid, cardioid, wide-angle cardioid, omnidirectional, sub-cardioid, and super-cardioid. In another embodiment, the control device 30 can vary the polar pattern of the microphone 20 among any one of the following or any combination of the following polar patterns: figure-of-eight, hypercardioid, cardioid, wide-angle cardioid, and omnidirectional. In one embodiment, the high-pass filter switch 42 controls the high pass filter 28 in the microphone 20. In another embodiment, the high-pass filter switch 42 controls the high pass filter 28 in the control device 30. The control device 30 can be mounted in single rack unit shelf A total of six control devices 30 can be mounted in one rack unit, for one non-limiting example, the Astatic RU1 In one embodiment, the control device 30 is 4 9/16 inches in length, 2⅞ inches in width and 1⅝ inches in height.

With reference now to FIGS. 1-9B, the specifications for one embodiment of the microphone system 10 will be described. According to this embodiment, the frequency response is 40 Hz-20 KHz; the sensitivity is −29 dBV (35 mV) @ 1 Pa; the impedance is 135 ohms; the self noise is 22 dBA; the maximum SPL is 110 dB, 1% THD, 1 KHz; and the power requirements are P12, P24, P48, 4 mA. According to one embodiment, positive pressure on the diaphragm of the capacitor capsule 70 corresponds to positive voltage on pin 2 relative to pin 3 at the XLRM-type connector.

With continuing reference to FIGS. 1-9B, the operation of the microphone system 10 will be described. In one embodiment, the cable 90 connects the microphone 20 to the control device 30, and the cable 92 connects the control device 30 to the mixer 80. The indicator 34 will indicate that there is a proper connection between the microphone 20, the control device 30, and the mixer 80. In one embodiment, a blue LED 34 will illuminate when the cables 90, 92 are properly connected and phantom power is applied to the system. In an alternate embodiment, the microphone 20 is wirelessly connected to the control device 30. After the indicator 34 indicates the microphone system 10 is properly connected either by cables 90, 92 or wirelessly, the control device 30 can vary the polar pattern of the microphone 20 or switch the high-pass filter 28 on or off. The control device 30 can continuously vary the microphone 20 among a variety of polar patterns. The control device 30 can vary the polar pattern when the microphone 20 is in use. As one non-limiting example, the control device 30 can vary the polar pattern from figure-of-eight to omnidirectional or anywhere in between these polar patterns. As another non-limiting example, the control device 30 can vary the polar pattern from figure-of-eight to hypercardioid or anywhere in between these polar patterns.

Still referring to FIGS. 1-9B, the operation according to one embodiment will now be described. In this embodiment, the cables 90, 92 are two-conductor-plus-shield audio cables. The signal from the front capsule 72 is on one conductor, and the signal from the rear capsule 74 is on the second conductor. The control device 30 can alter the amplitude and the polarity of the signal from the rear capsule 74. These two signals, one from the front capsule 72 and one from the rear capsule 74, remain separate until the signals enter the differencing amplifier in the audio mixer or preamplifier 80, where the actual polar pattern is created.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A microphone system comprising:

a microphone having at least two capacitor capsules; a control device external to the microphone and operatively connected to the microphone, wherein the control device is capable of varying the polar pattern of the microphone;

a mixer including a differencing amplifier;

a two-conductor shielded cable having a first conductor and a second conductor, wherein the two-conductor shielded cable operatively connects the microphone, the control device, and the mixer;

wherein a first signal from the first capsule is on the first conductor and a second signal from the second capsule is on the second conductor; and wherein the first and second signals remain separate until the first and second signals enter the differencing amplifier in the mixer, where the polar pattern is created.

2. The microphone system of claim 1 further comprising:

a printed circuit board located between the two capacitor capsules and being a substrate for electronics of the microphone.

3. The microphone system of claim 2, wherein the printed circuit board also functions as an acoustic baffle between the two capsules.

4. The microphone system of claim 1 further comprising:

an anti-rotational positioning mount comprising: an upper support arm secured to an associated ceiling; a counterpoise rod operatively attached to the microphone; and a cable rod operatively attached to the microphone and to the shielded cable;

wherein the anti-rotational positioning mount maintains the position of the microphone utilizing a thread attached to the upper support arm and the counterpoise rod;

wherein the microphone hangs supported from the ceiling by the shielded cable.

5. The microphone system of claim 1, wherein the at least two capacitor capsules are arranged back-to-back and not side-to-side.

6. The microphone system of claim 1, wherein the control device alters the amplitude and polarity of the second signal from the second capsule.

7. The microphone system of claim 1, wherein the control device further comprises an indicator that indicates when the microphone, the control device, and the mixer are properly connected.

8. The microphone system of claim 1, wherein the control device includes a high-pass filter.

9. The microphone system of claim 1, wherein the control device can continuously vary the polar pattern when the microphone is in use over the two-conductor shielded cable.

10. The microphone system of claim 9, wherein the control device can continuously vary the polar pattern of the microphone among any one of the group comprising a figure-of-eight polar pattern, a hypercardioid polar pattern, a cardioid polar pattern, a wide-angle cardioid polar pattern, an omnidirectional polar pattern, and any combination thereof.

11. A microphone system comprising:

a microphone including a dual-sided capsule having two diaphragms;

a control device external to the microphone and operatively connected to the microphone, wherein the control device is capable of varying the polar pattern of the microphone;

a mixer including a differencing amplifier;

a two-conductor shielded cable having a first conductor and a second conductor, wherein the two-conductor shielded cable operatively connects the microphone, the control device, and the mixer;

wherein a first signal from the first diaphragm is on the first conductor and a second signal from the second diaphragm is on the second conductor; and wherein the first and second signals remain separate until the first and second signals enter the differencing amplifier in the mixer, where the polar pattern is created.

12. The microphone system of claim 11 further comprising: a printed circuit board located between the two diaphragms of the dual sided capsule.

13. The microphone system of claim 12, wherein the printed circuit board can function as an acoustic baffle between the two capsules.

14. The microphone system of claim 7, wherein the indicator also indicates when phantom power is applied to the system.

15. The microphone system of claim 12, wherein the control device alters the amplitude and polarity of the second signal from the second diaphragm.

* * * * *